US010921049B1

(12) United States Patent
Rhyner et al.

(10) Patent No.: US 10,921,049 B1
(45) Date of Patent: Feb. 16, 2021

(54) PUSH-THROUGH CONDITIONED AIR VESTIBULE AND CONTROLLER

(71) Applicant: HCR Inc., Lewistown, MT (US)

(72) Inventors: Daniel J. Rhyner, Lewistown, MT (US); Gary Michael Landers, Lewistown, MT (US)

(73) Assignee: HCR Inc., Lewistown, MT (US)

( * ) Notice: Subject to any disclaimer, the term of this patent is extended or adjusted under 35 U.S.C. 154(b) by 113 days.

(21) Appl. No.: 14/885,294

(22) Filed: Oct. 16, 2015

Related U.S. Application Data

(60) Provisional application No. 62/067,346, filed on Oct. 22, 2014.

(51) Int. Cl.
*F24F 9/00* (2006.01)
*F25D 23/02* (2006.01)

(52) U.S. Cl.
CPC ..... *F25D 23/023* (2013.01); *F24F 9/00* (2013.01)

(58) Field of Classification Search
CPC ..... F25D 23/023; F24F 9/00
USPC ..... 454/192
See application file for complete search history.

(56) References Cited

U.S. PATENT DOCUMENTS 3,023,688 A * 3/1962 Kramer, Jr. ..... F24F 9/00 454/189
3,282,193 A * 11/1966 Jennings ..... F24F 9/00 454/191
4,086,950 A * 5/1978 Power ..... E06B 3/80 160/332
4,095,642 A * 6/1978 McKinnon ..... E06B 3/80 160/332
4,165,778 A * 8/1979 Smith ..... E06B 3/80 15/97.3
4,232,725 A * 11/1980 Gidge ..... E06B 3/80 160/332
4,289,190 A * 9/1981 Catan ..... E06B 3/80 160/184
4,355,678 A * 10/1982 Romano ..... E04B 1/84 160/327

(Continued)

OTHER PUBLICATIONS

"Relative Humidity in air", ReletiveHumidityinAir.pdf, Engineering Toolbox, [Retreived on Mar. 13, 2018], Rerevied from the internet: <URL: https://www.engineeringtoolbox.com/relative-humidity-air-d_687.html>.*

(Continued)

*Primary Examiner* — Grant Moubry
*Assistant Examiner* — Ryan L Faulkner
(74) *Attorney, Agent, or Firm* — Holland & Hart, LLP

(57) ABSTRACT

A push through conditioned air vestibule unit includes an air vestibule having a top side, a first lateral side, and a second lateral side forming a passage through the unit. Movable barrier members are attached to the unit to reduce external air flow through the passage. Return air ducts are configured to circulate air to an air moving device and a temperature conditioning device. Thermal and humidity sensors measure temperature and humidity of the passage and an external room, and a system controller controls the temperature of air moved into the passage using the temperature conditioning device if the partial pressure of moisture vapor internal to the passage is not greater than or equal to the partial pressure of moisture vapor external to the passage.

17 Claims, 4 Drawing Sheets

(56) References Cited

U.S. PATENT DOCUMENTS

| | | | | | |
|---|---|---|---|---|---|
| 4,516,482 | A * | 5/1985 | Smith | F25D 23/023 | 160/117 |
| 4,607,678 | A * | 8/1986 | Pomaville | E06B 3/80 | 160/332 |
| 6,106,387 | A * | 8/2000 | Smith | F24F 9/00 | 454/190 |
| 6,474,983 | B1 * | 11/2002 | Robbins | E06B 3/80 | 432/64 |
| 6,595,429 | B1 * | 7/2003 | Carlson | F24F 9/00 | 236/44 R |
| 6,960,129 | B2 * | 11/2005 | Ashley | F24F 9/00 | 454/188 |
| 6,976,763 | B2 * | 12/2005 | Robbins, III | E06B 3/80 | 160/330 |
| 8,376,822 | B1 * | 2/2013 | Smith | A61N 7/02 | 454/188 |
| 2004/0192187 | A1 * | 9/2004 | Ashley | F24F 9/00 | 454/191 |
| 2005/0197057 | A1 * | 9/2005 | Rohrer | F24F 9/00 | 454/191 |
| 2006/0199497 | A1 * | 9/2006 | Smith | F24F 9/00 | 454/173 |
| 2008/0233859 | A1 * | 9/2008 | Smith | A61N 7/02 | 454/188 |
| 2009/0291627 | A1 * | 11/2009 | Zimmermann | F24F 9/00 | 454/188 |
| 2010/0291856 | A1 * | 11/2010 | Berben | F24F 9/00 | 454/191 |

OTHER PUBLICATIONS

Greenheck Fan Corp., SFDSFBJanuary2004.pdf, "Models SFD & SFB: Forward curved utility fans", Greenheck Fan Corp. Jan. 2004 Rev. 2 [Retrevied on Mar. 13, 2018], Retreived from the internet <URL: https://web.archive.org/web/20051028095536/http://www.greenheck.com:80/pdf/fans/SFDSFBJanuary2004.pdf>.*

* cited by examiner

PUSH-THROUGH CONDITIONED AIR VESTIBULE AND CONTROLLER

CROSS REFERENCE TO RELATED APPLICATIONS

This application cross-references and claims the benefit of priority of U.S. Provisional Patent Application No. 62/067,346, filed 22 Oct. 2014, entitled PUSH-THROUGH CONDITIONED AIR VESTIBULE AND CONTROLLER, the disclosure of which is incorporated, in its entirety, by this reference.

TECHNICAL FIELD

The present invention relates to a conditioned air vestibule for a cold storage doorway. More particularly, the present invention relates to an air curtain arrangement and control system that controls temperature of the air discharged across a doorway and a method of controlling the airflow temperature to prevent formation of frost, water, and fog.

BACKGROUND

In the field of cold storage freezers and similar devices, various systems such as solid doors, strip curtains, and air curtains, may be used to separate the cold storage room from an adjacent relatively warm anteroom. It is desirable to allow traffic from people and equipment through a doorway between the cold storage room and the adjacent warm room safely and with a minimum transfer of relatively cool and warm air between the cold room and the warm room.

The use of air curtains is one method of allowing a doorway to remain open to traffic while also preventing substantial energy loss between the cold and warm sides of the vestibule. Air curtains generally direct air across the doorway to counter infiltration of warm to the cold room and exfiltration of cold air from the cold room. By way of example, air curtains may direct air horizontally or vertically across the doorway from or toward an upper portion of the air curtain.

As a safety precaution, it is desirable to prevent the formation of fog, ice, and water in the doorway. Ice may form from the mixing of air from the cold and warm sides of the vestibule. The formation of ice at an air curtain depends on the temperature and relative humidity of the cold and warm rooms, and may be characterized by a psychrometric saturation curve. The mixing of air from the relatively warm and cold sides may be characterized by a straight line between points representing the warm side temperature and humidity and the cold side temperature and humidity, which may be plotted on a psychrometric saturation chart along with the curve. Generally, ice may form whenever the temperature is below 32 degrees Fahrenheit and the mixing line is to the left of, and above, the psychrometric saturation curve, as it is typically plotted.

The formation of ice may be prevented by heating the air discharged from the air curtain. By way of example, the discharged air may be heated to a temperature at a point on the psychrometric saturation chart such that lines to such point from both the cold side and warm side temperature/humidity points remain to the right of, and below, the psychrometric saturation curve, as it is typically plotted.

While avoiding the formation of ice, water, and fog, it is also desirable to operate the air curtain as efficiently as possible, by adding the minimum amount of heat necessary to avoid such problems. With respect to the psychrometric saturation chart, this means keeping the point representing the airstream with the added heat as close to the saturation curve as possible, without causing mixing lines from this point to the cold side and warm side temperature/humidity points to contact or cross the saturation curve.

Because temperature and humidity conditions in the cold and warm side rooms may change, it is desirable in some applications to dynamically condition the discharged air in response to changing conditions. Conventional systems have various shortcomings. Some systems permit operation of the air curtain at points directly on the saturation curve. In changing environments, this permits the formation of ice, water, and fog because the system may not respond as quickly as the conditions change and because the sensors may not be sufficiently accurate for all positions in the vestibule. This is particularly a problem for systems that rely upon mathematical approximations of the psychrometric saturation curve.

SUMMARY

An aspect of the present disclosure relates to a push through conditioned air vestibule unit that may comprise an air vestibule having a top side, a first lateral side, and a second lateral side that may form a passage through the unit. A plurality of movable barrier members may be configured to reduce external air flow through the passage. First and second lateral side supply or return air ducts may be configured to supply air to or return air from the top side from the first and second lateral sides. An air moving device may be configured to circulate, receive, or supply air from the first and second lateral side return air ducts and to move air into the passage. The unit may also have a temperature conditioning device configured to adjust the temperature of air moved into the passage, an external thermal sensor configured to measure a temperature external to the passage, an internal thermal sensor configured to measure a temperature within the passage, an external humidity sensor configured to measure a humidity external to the passage, and an internal humidity sensor configured to measure a humidity internal to the passage. A system controller may be in communication with the external and internal thermal sensors and the external and internal humidity sensors and may be configured to increase the temperature of air moved into the passage using the temperature conditioning device if the partial pressure of moisture vapor internal to the passage is not greater than or equal to the partial pressure of moisture vapor external to the passage.

The movable barrier members of the unit may comprise flexible strips hanging from the top side of the unit and may be impact-type doors. A distance through the passage may be about 6 inches or greater. The first and second lateral return air ducts may comprise return air openings at bottom ends of the first and second lateral sides.

The system controller may be configured to maintain a partial pressure of moisture in the passage equal to or higher than a partial pressure of moisture external to the passage, such as, for example by being configured to cycle the temperature conditioning device on and off.

The air vestibule may be positioned between a first room and a second room, the first room having a warmer temperature than the second room. The external thermal sensor and the external humidity sensor may measure temperature and humidity, respectively, of the first room.

In another aspect, a method of controlling air condition in a conditioned air vestibule unit is provided. The method may comprise providing a conditioned air vestibule having a heat source, a plurality of thermal sensors, a plurality of humidity sensors, and an air moving device, measuring an external temperature and a vestibule temperature using the plurality of thermal sensors, measuring an external humidity and a vestibule humidity using the plurality of humidity sensors, calculating an external partial pressure of moisture vapor external to the vestibule, calculating a vestibule partial pressure of moisture vapor within the vestibule, and enabling the heat source to heat air provided to the air moving device if the vestibule partial pressure is greater than or equal to the external partial pressure.

The vestibule temperature and vestibule humidity may be measured within a passage through the conditioned air vestibule. The external temperature and external humidity may be measured from an external area warmer than a passage through the conditioned air vestibule.

In performing the method, the heat source may be cycled on and off. The method may further comprise circulating air in the conditioned air vestibule unit by drawing air from a bottom of the conditioned air vestibule into the air moving device and expelling air from the air moving device into the conditioned air vestibule after being heated by the heat source.

Air may also be moved into the conditioned air vestibule using the air moving device. The air moved into the vestibule may remove or prevent formation of ice and/or frost in the conditioned air vestibule.

Some embodiments may comprise a non-transitory computer-readable medium having instructions encoded thereon that, when executed by a processor of a computer, cause the computer to perform steps comprising: measuring an external temperature and a vestibule temperature of a conditioned air vestibule having a heat source, a plurality of thermal sensors, a plurality of humidity sensors, and an air moving device, the external and vestibule temperatures being measured using the plurality of thermal sensors; measuring an external humidity and a vestibule humidity using the plurality of humidity sensors; calculating an external partial pressure of moisture vapor external to the vestibule; calculating a vestibule partial pressure of moisture vapor within the vestibule; and enabling the heat source to heat air provided to the air moving device if the vestibule partial pressure is greater than or equal to the external partial pressure.

The above summary of the present invention is not intended to describe each embodiment or every implementation of the present invention. The Figures and the detailed description that follow more particularly exemplify a preferred embodiment.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
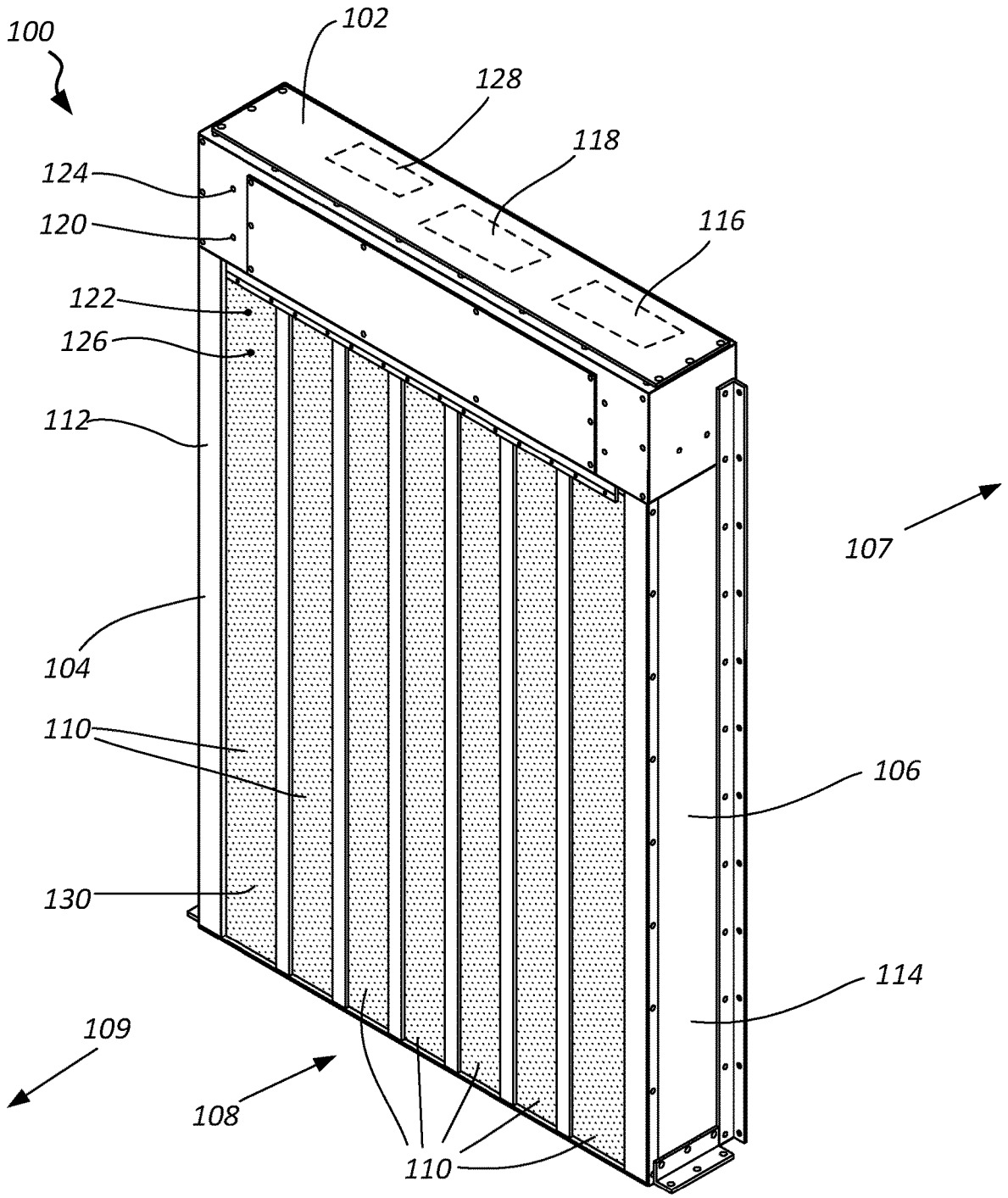
FIG. 1 is a perspective view of an example of a push-through conditioned air vestibule of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Aspects of the present disclosure may improve the effectiveness of conditioned air vestibules such as those used to link freezers to warmer areas. These systems may reduce refrigeration load while preventing frost, ice, and wetness at the entryway to the vestibule. An example embodiment of the vestibule may comprise two pairs of impact-type doors, or fixed strips, and an electrically or hot-gas heated anti-frost air-conditioning (AFC) section with temperature reset control. In some cases, the vestibule may be about 6 inches in depth in the direction of travel through the vestibule. These benefits may reduce refrigeration losses, increase warehouse (or other commercial or industrial location) productivity, reduce coil defrosting burdens, and improve refrigeration cycle efficiency.

FIG. 1 shows an example of a push-through conditioned air vestibule 100 according to an embodiment of the present disclosure. The vestibule 100 comprises a top side 102, a first lateral side 104, and a second lateral side 106 through which a passage 108 is formed. The passage 108 may be lined with movable barrier members 110 on each end of the passage 108. The first lateral side 104 may comprise a first air return duct 112, and the second lateral side 106 may comprise a second air return duct 114. These ducts 112, 114 may be configured to bring air to the top side 102 from their respective lateral sides 104, 106. An air moving device 116 may be positioned in the top side 102 and configured to receive air from the return air ducts 112, 114 and then move air into the passage 108, such as through vents exposed into the passage 108 at the top side 102 of the vestibule 100. The top side 102 may also comprise a temperature conditioning device 118 that receives airflow and adjusts the temperature of air moved into the passage 108.

An external thermal sensor 120 may be configured to measure a temperature of external air, such as the temperature of a warm room outside the passage 108, and an internal thermal sensor 122 may be configured to measure the temperature of air in the passage 108. An external humidity sensor 124 and internal humidity sensor 126 may also be configured to measure humidity of their respective areas relative to the passage 108.

The vestibule 100 may also include a system controller 128 configured to control the temperature conditioning device 118 and air moving device 116 while receiving data from the sensors (e.g., sensors 120, 122, 124, 126).

In some embodiments the vestibule 100 may comprise more than one unit, such as multiple vestibules 100 having aligned passages in a series. The vestibule 100 may be positioned such that it separates a cooler area from a warmer area. A common application would be use of the vestibule 100 as an air curtain between a freezer and a warm room of a warehouse, for example. In a single vestibule 100, more than one air curtain may be implemented, such as a first air curtain directing air primarily toward the first lateral side 104 and a second air curtain directing air primarily toward the second lateral side 106 adjacent to the first air curtain.

The top side 102 may include a conduit system connecting the lateral side return air ducts 112, 114 to the air moving device 116 and the temperature conditioning device 118. Positioning the air moving device 116 and temperature conditioning device 118 in the top side 102 may be beneficial because the top side 102 is central to each of the lateral sides 104, 106, so only one air moving device 116 and/or temperature conditioning device 118 may be required to receive and control air flow for both lateral sides 104, 106. Additionally, positioning these components 116, 118 in the top side 102 may reduce the lateral profile of the vestibule 100, thereby either allowing the vestibule 100 to fit within narrower openings or to maximize the width of the passage 108.

The top side 102 in FIG. 1 is shown having the controller 128 housed therein, but the controller 128 may alternatively be stored in another area of the vestibule 100. For example, the controller 128 may be positioned in one of the lateral sides 104, 106 to be more accessible from the ground level.

The first lateral side 104 and second lateral side 106, along with the return air ducts 112, 114, may extend from a ground level to the top side 102 of the vestibule 100. The return air ducts 112, 114 may each have a return air vent 130 positioned near the ground level. At the ground level, the return air vents 130 may receive cooler air that is moved up through the return air ducts 112, 114 by the air moving device 116 to the top side 102 where its temperature may be adjusted by the temperature conditioning device 118. In an alternative embodiment, the air discharge openings may be situated near or in the floor of the air curtain and the return vents may be situated in or near the upper portion of the air curtain, such that the air is discharged across the opening in a generally upward direction.

The passage 108 may extend between the first and second lateral sides 104, 106 and may be used as a doorway between rooms 107, 109 on each side of the vestibule 100. See FIG. 1. In an example embodiment, the passage 108 may be about 6 inches across (i.e., between the movable barrier members 110 at each end of the passage 108). The passage 108 may allow push-through access, meaning personnel, carts, vehicles, and equipment may push or move through the passage 108 unimpeded.

The movable barrier members 110 may comprise strips of flexible material, such as, for example, vinyl strips that hang from the top side 102 to the ground level. The movable barrier members 110 may be connected by clips, fasteners, or joints to the top side 102. In some embodiments the movable barrier members 110 may be referred to as impact-type doors. The movable barrier members 110 may provide insulation and airflow isolation to the passage 108 by acting as a barrier to airflow while hanging vertically, yet may not hinder the passage of equipment and personnel through the passage 108. Thus, the movable barrier members 110 may help maintain the temperature and humidity of air within the passage 108 due to preventing the outflow or inflow of external air while they close off the ends of the passage 108.

The air moving device 116 may comprise a device that, when active, pushes or pulls air through the ducts of the vestibule 100 and through the passage 108. One example air moving device 116 may comprise a fan or plurality of fans that may be driven by an electric motor. The motor may be controlled by the system controller 128 so that the speed and direction of motion of the fan may be controlled by the controller 128.

The temperature conditioning device 118 may comprise a heating or cooling system capable of changing the temperature of air flowing through the ducts of the vestibule 100. For example, a temperature conditioning device 118 may comprise a heater comprising electric coils or heated pipes that warm the air in the ducts as it passes by the coils or pipes. In some arrangements the temperature conditioning device 118 may be controllable to output a desired amount of heat based on commands received from the system controller 128. In one application, the temperature conditioning device 118 may beneficially be a heater so that air provided to the passage 108 may be warmer than air in a cold side of the vestibule 100.

The heat provided by the temperature conditioning device 118 may also affect the humidity of the air in the ducts and passage 108, so in some configurations the vestibule 100 may further comprise a humidity conditioning device configured to increase or decrease the relative humidity of air in the passage 108. In some embodiments, the humidity conditioning device may expel water or mist into the air at or near the temperature conditioning device 118.

The external thermal sensor 120 and internal thermal sensor 122 may comprise thermocouples configured to measure temperature external or internal to the passage 108. Other types of thermal sensors may also be used. The external humidity sensor 124 and internal humidity sensor 126 may comprise electronic hygrometers. The external thermal sensor 120 and external humidity sensor 124 may be positioned to measure temperature and humidity of a warm room to the front or rear of the vestibule 100. The internal thermal and humidity sensors 122, 126 may measure the temperature and humidity of air in the passage 108.

Figure 2:
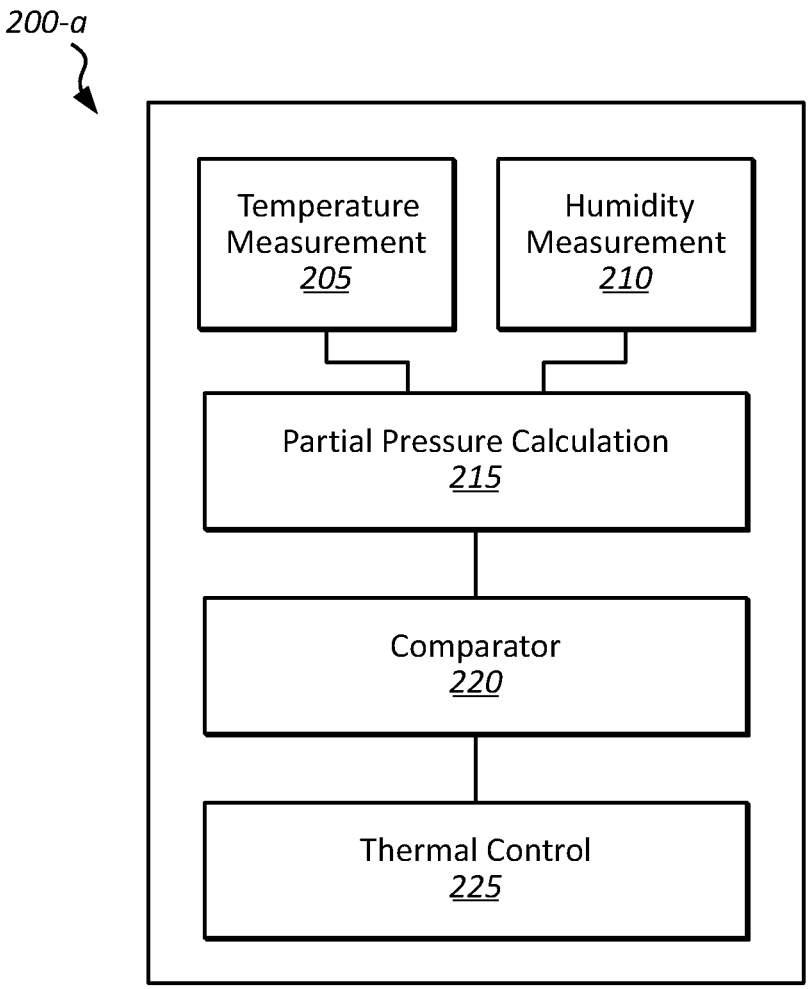
FIG. 2 is a block diagram of modules implemented by a system controller of a push-through conditioned air vestibule of the present disclosure.

The system controller 128 may be a computing device such as, for example, a computer or integrated control circuit. A computer system suitable for implementing the system controller 128 is described in further detail in connection with FIG. 4. The system controller 128 may comprise a plurality of modules for executing its functions. As shown in FIG. 2, a system controller 128 may comprise a vestibule control module 200-*a*. The vestibule control module 200-*a* may comprise a plurality of modules executable by the system controller 128.

The vestibule control module 200-*a* may comprise a temperature measurement module 205 and a humidity measurement module 210. The temperature measurement module 205 may be configured to receive signals from the thermal sensors 120, 122 and convert the signals into signals readable by a partial pressure calculation module 215. Likewise, the humidity measurement module 210 may receive signals from the humidity sensors 124, 126 and convert the signals into a form readable by the partial pressure calculation module 215.

A partial pressure calculation module 215 may receive the signals from the temperature and humidity measurement modules 205, 210 and may implement psychrometric equations to calculate the partial pressures of moisture vapor in the air of the vestibule and external to the vestibule. The temperature and relative humidity of the external area and of the vestibule may be used as inputs to these equations. In one example embodiment, the following equations may be implemented:

$$L_o=C_8/T_o+C_9+C_{10}T_o+C_{11}T_o^2+C_{12}T_o^3+C_{13}lnT_o \quad \text{[Equation 1]},$$

$$L_i=C_8/T_i+C_9+C_{10}T_i+C_{11}T_i^2+C_{12}T_i^3+C_{13}lnT_i \quad \text{[Equation 2]},$$

$$P_{wso}=e^{Lo} \quad \text{[Equation 3]},$$

$$P_{wsi}=e^{Li} \quad \text{[Equation 4]},$$

$$P_{wo}=\Phi_o(P_{wso}) \quad \text{[Equation 5], and}$$

$$P_{wi}=\Phi_i(P_{wsi}) \quad \text{[Equation 6]},$$

wherein:

$T_o$ is the temperature of air in the external area, $T_i$ is the temperature of air in the vestibule, $P_{wo}$ is the partial pressure of vapor in the external area, $P_{wi}$ is the partial pressure of vapor in the vestibule, $\Phi_o$ is the relative humidity of the external area, $\Phi_i$ is the relative humidity of the vestibule, $P_{wso}$ is the saturation pressure of the external area, $P_{wsi}$ is the saturation pressure of the vestibule, $L_o$ is the natural log of saturation pressure of the external area, $L_i$ is the natural log of saturation pressure of the vestibule, $C_8=-1.0440397\times10^4$, $C_9=-11.294650$, $C_{10}=-2.7022355\times10^{-2}$, $C_{1i}=1.2890360\times10^{-5}$, $C_{12}=-2.4780681\times10^{-9}$, and $C_{13}=6.5459673$. Thus, the partial pressure calculation module 215 may determine $P_{wo}$ and $P_{wi}$ and provide these values to the comparator module 220. The comparator module 220 may receive partial pressure calculations from the partial pressure calculation module 215, compare the partial pressure values, and send a result to a thermal control module 225.

The thermal control module 225 may receive the results of the comparator module 220 and, via an interface with the air moving device 116 and the temperature conditioning device 118, may control the temperature and humidity of air provided to the passage 108 of the vestibule 100.

Figure 3:
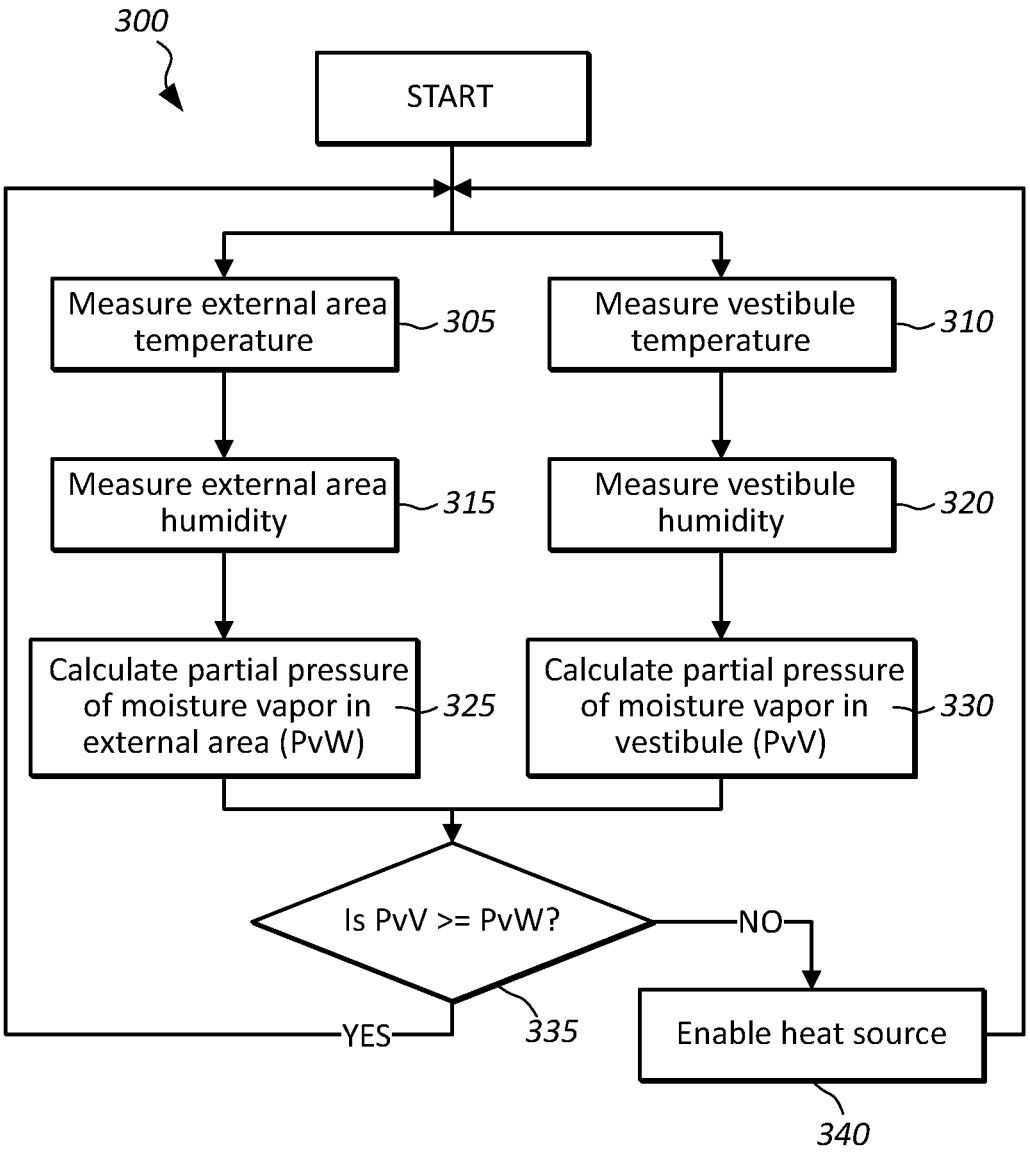
FIG. 3 is a flowchart illustrating an example process by which a heat source may be controlled in a push-through conditioned air vestibule.

FIG. 3 illustrates an embodiment of a process 300 that may be executed by the modules of the system controller 128. The process 300 may include blocks 305 and 310, wherein the temperature of the air of the external area and the vestibule air are measured. These temperatures may be measured by the internal and external thermal sensors 122, 120, respectively. In blocks 315 and 320, the humidity of the air of the external area and the vestibule air may be measured, such as by the external and internal humidity sensors 124, 126. At blocks 325 and 330, the system controller 128 may calculate the partial pressure of moisture vapor in the external area and in the vestibule. At block 335, the system controller 128 may compare the partial pressures calculated in blocks 325 and 330 and determine whether the partial pressure of moisture vapor in the vestibule (i.e., PvV) is greater than or equal to the partial pressure of moisture vapor in the external area (i.e., PvW). If PvV is less than PvW, the system controller 128 may execute block 340 to enable a heat source. The heat source may be part of the temperature conditioning device 118. Enabling the heat source may comprise turning a heat source in the temperature conditioning device 118 on and off. If PvV is greater than or equal to PvW, the process 300 may restart and continue to monitor conditions in the vestibule and external area.

Figure 4:
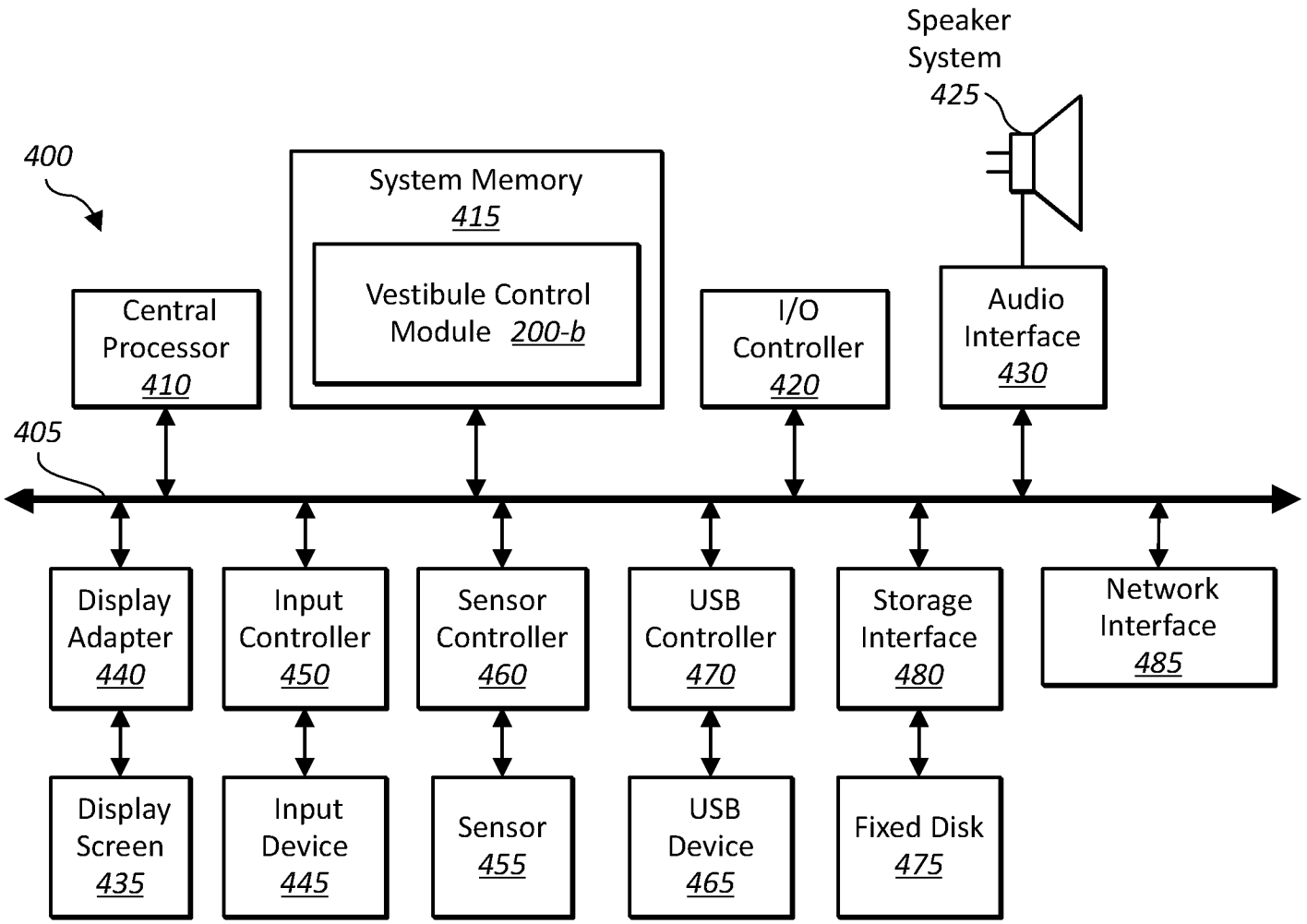
FIG. 4 is a block diagram of a computer system that may be used to implement embodiments of the present disclosure.

FIG. 4 depicts a block diagram of a computer system 400 suitable for implementing the present systems and methods. Computer system 400 includes a bus 405 which interconnects major subsystems of computer system 400, such as a central processor 410, a system memory 415 (typically RAM, but which may also include ROM, flash RAM, or the like), an input/output controller 420, an external audio device, such as a speaker system 425 via an audio output interface 430, an external device, such as a display screen 435 via display adapter 440, an input device 445 (e.g., a keyboard, touchscreen, etc.) (interfaced with an input controller 450), a sensor 455 (interfaced with a sensor controller 460), one or more universal serial bus (USB) device 465 (interfaced with a USB controller 470), and a storage interface 480 linking to a fixed disk 475. A network interface 485 is also included and coupled directly to bus 405.

Bus 405 allows data communication between central processor 410 and system memory 415, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, a vestibule control module 200-*b* which may implement the present systems and methods may be stored within the system memory 415. Applications resident with computer system 400 are generally stored on and accessed via a non-transitory computer readable medium, such as a hard disk drive (e.g., fixed disk 475), an optical drive (e.g., an optical drive that is part of a USB device 465 or that connects to storage interface 480), or other storage medium. Additionally, applications can be in the form of electronic signals modulated in accordance with the application and data communication technology when accessed via network interface 485.

Storage interface 480, as with the other storage interfaces of computer system 400, can connect to a standard computer readable medium for storage and/or retrieval of information, such as a fixed disk drive 475. Fixed disk drive 475 may be a part of computer system 400 or may be separate and accessed through other interface systems. A modem connected to the network interface 485 may provide a direct connection to a remote server via a telephone link or to the Internet via an internet service provider (ISP). Network interface 485 may provide a direct connection to a remote server via a direct network link to the Internet via a POP (point of presence). Network interface 485 may provide such connection using wireless techniques, including digital cellular telephone connection, Cellular Digital Packet Data (CDPD) connection, digital satellite data connection or the like.

Many other devices or subsystems (not shown) may be connected in a similar manner (e.g., document scanners, digital cameras and so on). Conversely, all of the devices shown in FIG. 4 need not be present to practice the present systems and methods. The devices and subsystems can be interconnected in different ways from that shown in FIG. 4. The operation of a computer system such as that shown in FIG. 4 is readily known in the art and is not discussed in detail in this application. Code to implement the present disclosure can be stored in a non-transitory computer-readable medium such as one or more of system memory 415, or fixed disk 475. The operating system provided on computer system 400 may be MS-DOS®, MS-WINDOWS®, OS/2®, UNIX®, Linux®, or another known operating system.

Moreover, regarding the signals and network communications described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiments are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

What is claimed is:

1. A push through conditioned air vestibule unit configured to be positioned and provide access between a first room and a second room, the first room being warmer than the second room, the unit comprising:

an air vestibule having a top side, a bottom side, a first lateral side, and a second lateral side, the top, bottom and first and second lateral sides forming a passage through the unit;

a plurality of movable barrier members mounted to the top side and extending toward the bottom side, and configured to reduce external air flow through the passage;

a first lateral side supply or return air duct and a second lateral side supply or return air duct, the first lateral side air duct configured to supply air to or return air from the top side from the first lateral side, the second lateral side air duct configured to bring air to the top side from the second lateral side;

an air moving device configured to receive or supply air from the first and second lateral side return air ducts and to move air into the passage;

a temperature conditioning device configured to adjust the temperature of air moved into the passage;

an external thermal sensor positioned outside of the passage and configured to measure a temperature in the first room;

an internal thermal sensor configured to measure a temperature within the passage;

an external humidity sensor positioned outside of the passage and configured to measure humidity in the first room;

an internal humidity sensor configured to measure humidity within the passage;

a system controller in communication with the external and internal thermal sensors and the external and internal humidity sensors, the system controller configured to determine a partial pressure of moisture vapor internal to the passage using the temperature and humidity measured only in the passage and a partial pressure of moisture vapor of the first room using the temperature and humidity measured only in the first room, and to increase the temperature of air moved into the passage using the temperature conditioning device if the partial pressure of moisture vapor internal to the passage is not greater than or equal to the partial pressure of moisture vapor of the first room only.

2. The push through conditioned air vestibule unit of claim 1, wherein the movable barrier members comprise flexible strips hanging from the top side of the unit.

3. The push through conditioned air vestibule unit of claim 1, wherein the movable barrier members are impact-type doors.

4. The push through conditioned air vestibule unit of claim 1, wherein a distance through the passage is about 6 inches or greater.

5. The push through conditioned air vestibule unit of claim 1, wherein the first and second lateral return air ducts comprise return air openings at bottom ends of the first and second lateral sides.

6. The push through conditioned air vestibule unit of claim 1, wherein the system controller is configured to maintain a partial pressure of moisture in the passage equal to or higher than a partial pressure of moisture external to the passage.

7. The push through conditioned air vestibule unit of claim 1, wherein the controller is configured to cycle the temperature conditioning device on and off.

8. A method of controlling air condition in a conditioned air vestibule unit, the method comprising:

providing a conditioned air vestibule having a heat source, a plurality of thermal sensors, a plurality of humidity sensors, and an air moving device;

positioning the vestibule between a first room and a second room, the first room being warmer than the second room, the vestibule providing access between them and being exposed to the first and second rooms;

measuring an external temperature and a vestibule temperature using the plurality of thermal sensors, the external temperature being a temperature in the first room, the vestibule temperature being a temperature within a passage of the vestibule;

measuring an external humidity and a vestibule humidity using the plurality of humidity sensors, the external humidity being a humidity in the first room, the vestibule humidity being a humidity within the passage of the vestibule;

calculating an external partial pressure of moisture vapor external to the vestibule using the external temperature and the external humidity using the temperature and humidity measured only in the first room;

calculating a vestibule partial pressure of moisture vapor within the passage of the vestibule using the vestibule temperature and the vestibule humidity using the temperature and humidity measured only in the passage;

enabling the heat source to heat air provided to the air moving device to increase the vestibule temperature if the vestibule partial pressure of moisture vapor is greater than or equal to the external partial pressure of moisture vapor.

9. The method of claim 8, wherein the vestibule temperature and vestibule humidity are measured within a passage through the vestibule.

10. The method of claim 8, wherein the heat source is cycled on and off.

11. The method of claim 8, further comprising circulating air in the vestibule by drawing air from a bottom of the vestibule into the air moving device and expelling air from the air moving device into a passage of the vestibule after being heated by the heat source.

12. The method of claim 8, further comprising moving air into the vestibule using the air moving device.

13. The method of claim 12, wherein the air moved into the vestibule removes or prevents formation of ice and/or frost in the vestibule.

14. A non-transitory computer-readable medium having instructions encoded thereon that, when executed by a processor of a computer, cause the computer to perform steps comprising:

controlling a vestibule, the vestibule having a heat source, a plurality of thermal sensors, a plurality of humidity sensors, a passage, and an air moving device, the vestibule being positioned and providing access between first and second rooms, the first room being warmer than the second room;

measuring, with the plurality of thermal sensors, an external temperature and a vestibule temperature, the external temperature being a temperature in the first room, the vestibule temperature being a temperature within the passage of the vestibule;

measuring, with the plurality of humidity sensors, an external humidity and a vestibule humidity, the external humidity being a humidity in the first room, and the vestibule humidity being a humidity within the passage of the vestibule;

calculating an external partial pressure of moisture vapor in the first room using the external temperature and the external humidity from the first room only;

calculating a vestibule partial pressure of moisture vapor within the passage of the vestibule using the vestibule temperature and the vestibule humidity from the passage only;

enabling the heat source to heat air provided to the air moving device if the vestibule partial pressure of moisture vapor is greater than or equal to the external partial pressure of moisture vapor.

15. The non-transitory computer-readable medium of claim 14, wherein the steps further comprise cycling the heat source on and off.

16. The non-transitory computer-readable medium of claim 14, wherein the steps further comprise circulating air in the vestibule by drawing air from a bottom of the vestibule into the air moving device and expelling air from the air moving device into a passage of the vestibule after being heated by the heat source.

17. The non-transitory computer-readable medium of claim 14, wherein the steps further comprise moving air into a passage of the vestibule using the air moving device.

* * * * *